US005752638A

United States Patent [19]

Meeks

[11] Patent Number: 5,752,638

[45] Date of Patent: May 19, 1998

[54] COMBINATION WATER SKI AND WAKE BOARD RACK

[76] Inventor: Todd Scott Meeks, 1043 Cynthia La., San Jose, Calif. 95129

[21] Appl. No.: 814,044

[22] Filed: Mar. 10, 1997

Related U.S. Application Data

[63] Continuation-in-part of Ser. No. 767,591, Dec. 4, 1996, abandoned.

[51] Int. Cl.[6] ..... B60R 9/12

[52] U.S. Cl. ..... 224/547; 224/324; 224/406; 224/917.5; 224/558; 224/568; 224/571; 211/70.5; 248/220.22; 248/221.11

[58] Field of Search ..... 224/917.5, 406, 224/324, 323, 547, 553, 568, 571, 558; 211/70.5, 85.7; 248/220.22, 221.11, 230.1

[56] References Cited

U.S. PATENT DOCUMENTS 3,018,897 1/1962 Caryle ..... 224/917.5
3,209,970 10/1965 Canell ..... 224/917.5
4,081,118 3/1978 Mason ..... 224/324

*Primary Examiner*—Linda J. Sholl
*Attorney, Agent, or Firm*—Robert Samuel Smith

[57] ABSTRACT

A rack for storing one or more pairs of water skis and wake boards including one or more pairs of forks having parallel prongs extending from and coplanar with a base plate section. The pairs of forks are mounted on a support bar extending through an opening in the base plate section and may be positioned axially along and orientationally around the bar then clamped in the selected position such that each fork is aligned with its pair member. Each pair of forks preferably has three prongs for stowing one pair of skis or two prongs for storing a wakeboard. A strap is provided for each neighboring pair of each fork having one end attached to an end of one of said neighboring pair of prongs and another end hookable to an end of the neighboring prong so that the strap may be stretched over a water ski or wakeboard nested between neighboring prongs thereby securing a pair of skis or wakeboards.

9 Claims, 10 Drawing Sheets

COMBINATION WATER SKI AND WAKE BOARD RACK

CROSS REFERENCE TO RELATED APPLICATIONS

This applicaion is a continuation in part of application Ser. No. 08/767,591 filed Dec. 4, 1996 now abandoned for which priority is claimed.

FIELD OF THE INVENTION

This invention relates to racks for stowing water skis and/or a wake board and particularly to a rack with a compound base that is transferrable from one location to another such as on a small boat and in a garage.

PRIOR ART AND INFORMATION DISCLOSURE

It is generally necessary to stow a pair of water skis and/or a wakeboard in more than one location. For example, one location may be on a small boat, another location may be in a garage, yet another location may be on a car or truck for transportation between his garage and boat. The surfing enthusiast often uses both a pair of skis and a wakeboard on his outing so that storing conveniently storing BOTH items is desirable.

Numerous disclosures of racks for water skis have appeared in the patent literature but none have appeared for wakeboards.

For example, U.S. Pat. No. 4,907,525 describes a rack comprising a pair of frame sections secured by suction cups along the gunwale and outboard of the boat hull. An upper and a lower horizontal section of the frame are each provided with upright ski retainers to receive and retain the pair of skis, the upper section retaining one ski and the lower section retaining the other ski.

U.S. Pat. No. 4,896,519 discloses a locking apparatus comprising a padded U-shaped metal band sized for looping around a rear section of a surfboard anterior to a rear fin with two ends of the band padlocked to a metal cable whose other end is attached to a permanent fixture where locking is feasible.

U.S. Pat. No. 4,863,082 discloses a water ski rack comprising a two piece structure with slots for two water skis. A lower framed panel is bracketed to the ski boat and an upper framed panel has slots fronted with an elastic band. When the upper framed panel is closed down on the lower framed panel with the skis in the slots, the elastic band expands into the upper slots and restrains the skis from rattling.

U.S. Pat. No. 4,858,802 discloses a rack for storing water skis on a ski boat outside the cockpit comprising at least two rack members, each comprising two perpendicular arms forming generally upwardly facing V-support and a base adapted to mount the V-shaped support on the boat outside the cockpit.

U.S. Pat. No. 4,582,015 discloses a ski rack for supporting skis in a position outboard one side of a tow boat having a pair of support members held in sockets which can be clampd to the hull of the boat. The support members comprise arms extending downward and having pairs of fingers on the lower end which extend upward and engage the skis.

U.S. Pat. No. 4,330,065 discloses a portable rack for storing and transporting water skis capable of being mounted over the engine of a water ski boat or carried by hand with the water skis in place.

U.S. Pat. No. 4,234,112 discloses a ski rack for water skis comprising a mounting frame having telescopically and rotatably adjustable leg supports extending in one direction for releasable attachment to the boat and one or more mounting posts extending in the opposite direction which cooperate with adjustable stops to releasably retain the skis in position on the mounting frame.

U.S. Pat. No. 4,056,220 discloses a portable ski rack that may be releasably mounted on a boat transom comprising spaced connected end members with slots for receiving the skis. The end members are provided with rods slidable through the end members to permit the rack to be accommated to different size boats. A strap is releasably trained over the edge of each member to secure the skis.

U.S. Pat. No. 3,776,437 discloses at least one elongated member securable to a boat deck with a plurality of bifurated elements mounted adacent opposite ends of the elongated member, the bifurcated members adapted to receive and frictionally engage a pair of water skis.

U.S. Pat. No. 3,701,436 discloses a water ski rack comprising two spaced rack units, each comprising a fork-like rack element having three tines adapted to receive the skis and a projecting prong adated to be plugged into a socket in a bracket mounted on a suitble supporting structure.

None of the racks of the cited art disclose a rack that can easily be mounted on any one of the sidewall of a pickup truck, garage wall, or a small boat on which a pair of skis and a wake board can be conveniently oriented and stored.

SUMMARY

It is an object of this invention to provide a rack for storing a pair of skis and/or one or two wakeboards.

It is another object to provide an ability to adjust the position of the skis and/or one or two wakeboards secured to the rack.

It is another object that the rack present the option to be transferred to a number of locations such as a garage wall, truck sidewall or to the gunwale or pylon of a small boat.

This invention is directed toward at least one pair of two or three pronged forks mounted on a rod such that each fork may be positioned on the rod and then clamped to the rod with the prongs extending away from the rod. A pair of skis may be stored with one end of each ski engaged between neighboring prongs of one fork and another end of each ski engaged between neighboring prongs of the other fork. The skis are securely nested between the prongs by flexible bands. Each flexible band extends from the end of a central prong, over the ski and is hooked onto an extending end of a neighboring prong. The rod is secured to a compound base of two parts conveniently separable from one another in which one part may be secured to a base such as a truck sidewall, garage wall or pylon of a boat and the other part (which detachably engages the first part) supports the rod holding the skis and/or wakeboard.

The skis stored on the rack may be positioned by rotating the pair of forks.

The length of the prongs are selected to accommodate the width of the water skis. Forks with longer prongs are provided when it is required to store a wake board in the rack. A first pair of forks can be mounted on the rod for storing a pair of skis and a second pair of forks can be mounted along side the first pair and oriented in a different direction than the first pair when it is required to store both a pair of skis and one or two wake boards simultaneously.

DESCRIPTION OF BEST EMBODIMENTS

Figure 1:
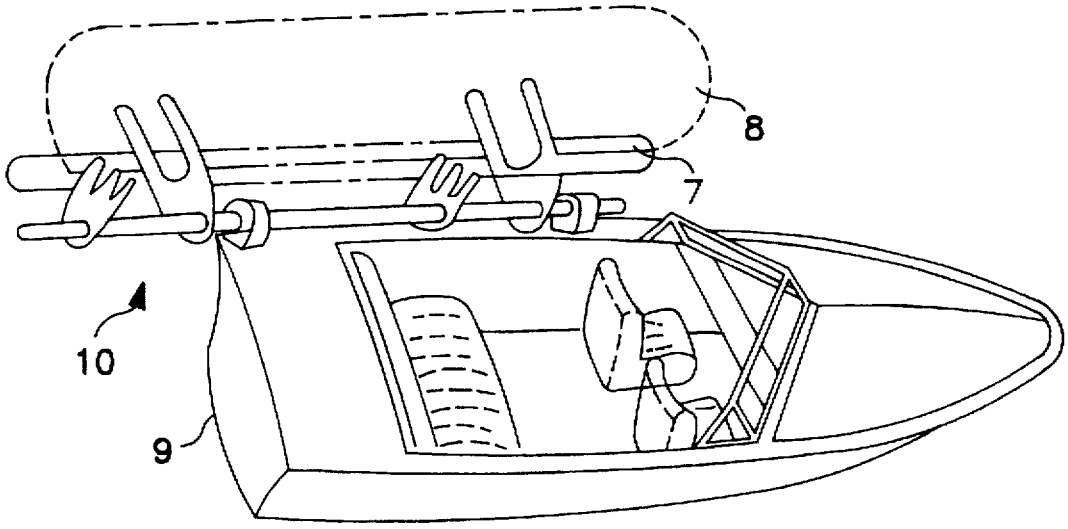
FIG. 1 shows the rack mounted on a boat.
Figure 2:
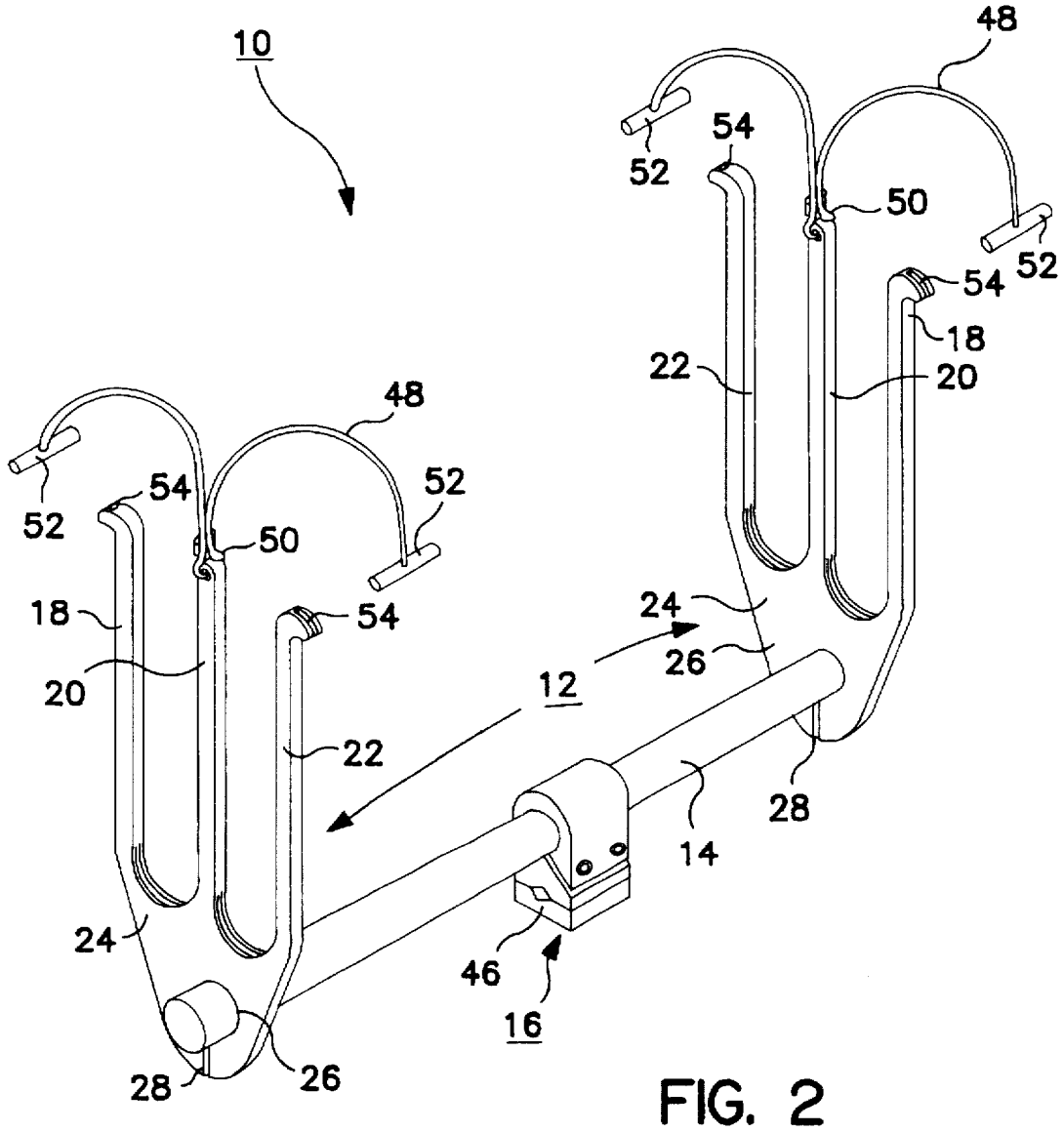
FIG. 2 shows an assembly perspective view of the rack for holding one pair of skis.
Figure 3:
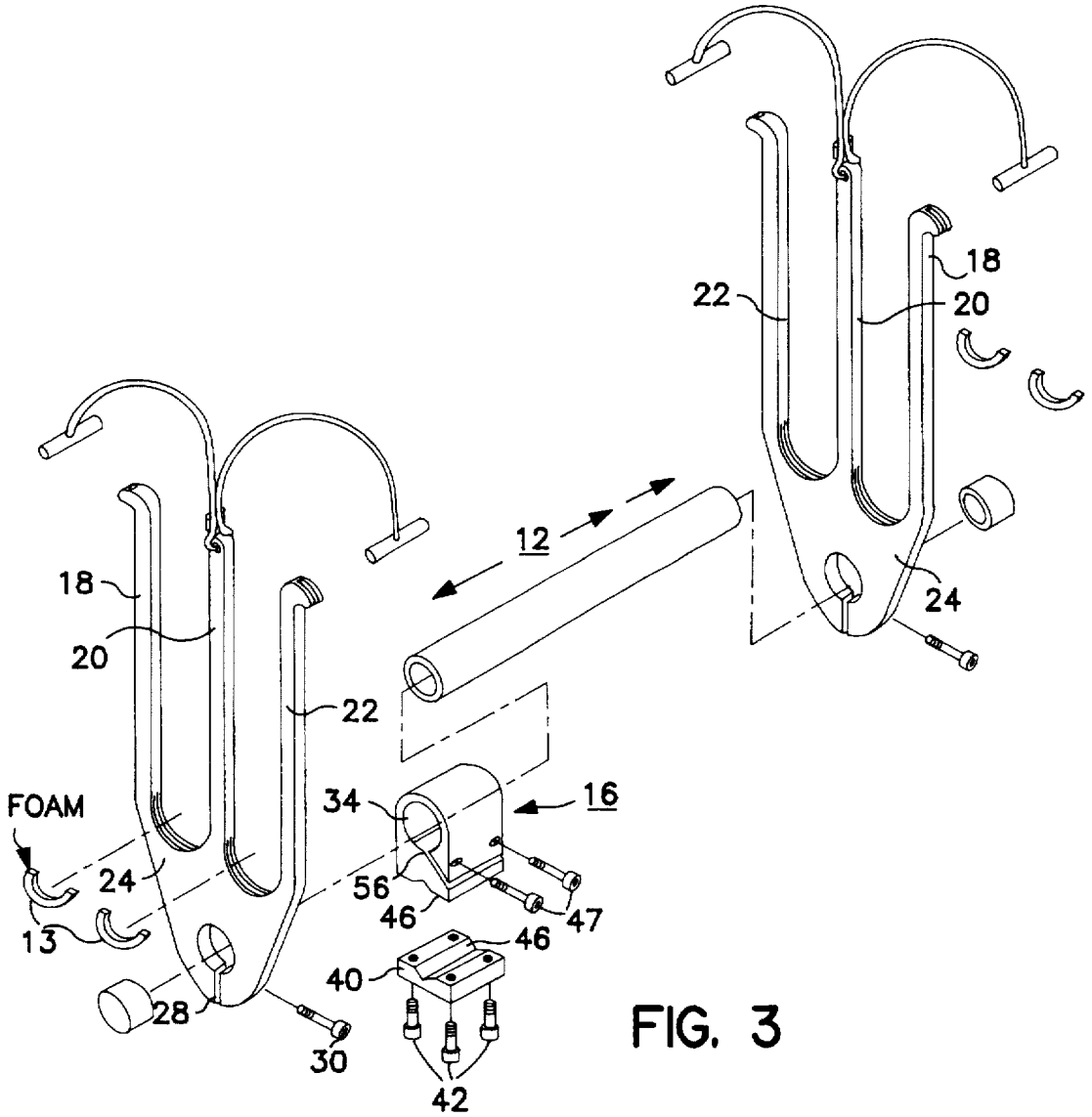
FIG. 3 shows an exploded view of FIG. 1.

Turning now to a discussion of the drawings, FIG. 1 shows the combination rack 10 of this invention mounted on a boat 9 and holding a wake board 8 and ski 7. Ski 7 and wake board 8 are shown in phantom in FIG. 1. FIG. 2 shows an assembly view of the invention and FIG. 3 is an exploded view of FIG. 2.

There are shown two forks 12, each fork 12 having three prongs 18, 20 and 22 extending extending away from a base section 24. Each fork 12 is supported by a support bar 14 passing through an opening 26 in the base section. Each fork may be slidably positioned axially along support bar and positioned orientationally around support bar 14. Screw 30 can close slot 28 in order to secure each fork on the bar.

The support bar 14 is positioned in opening 34 of bracket 16 and clamped by bolts 47 tightening slot 36 of bracket 16. Bracket 16 is bolted onto base plate 40 by bolts 42. The bracket 16 is secured to the boat by grooves 46 in bracket 16 and base plate 40 which form an opening for engaging a railing (railing not shown) of the boat (boat not shown). Alternatively, the bracket may be directly bolted to a sidewall of a truck or gunwale of a boat by bolts 42.

Figure 4:
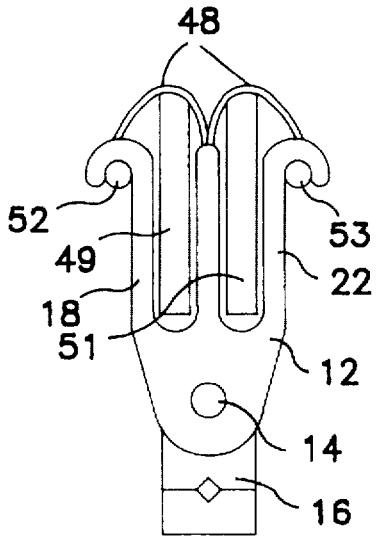
FIG. 4 shows an end view of a pair of skis in the rack of FIG. 1.

FIG. 4 is an end view of the rack showing the end view of ski 49 between prongs 18 and 20 and ski 51 between prongs 20 and 22. A strap 48 is fastened at its center to prong 20 of each fork 12. One end 52 of strap 48 is hook to the extending end of prong 18 and the other end 53 of strap 48 is hooked to the extending end of prong 22 so that skis 49 and 51 are retained in their respective positions in the rack. A pad 13 in the crotch between neighboring prongs is provided for protection of the ski.

Figure 5:
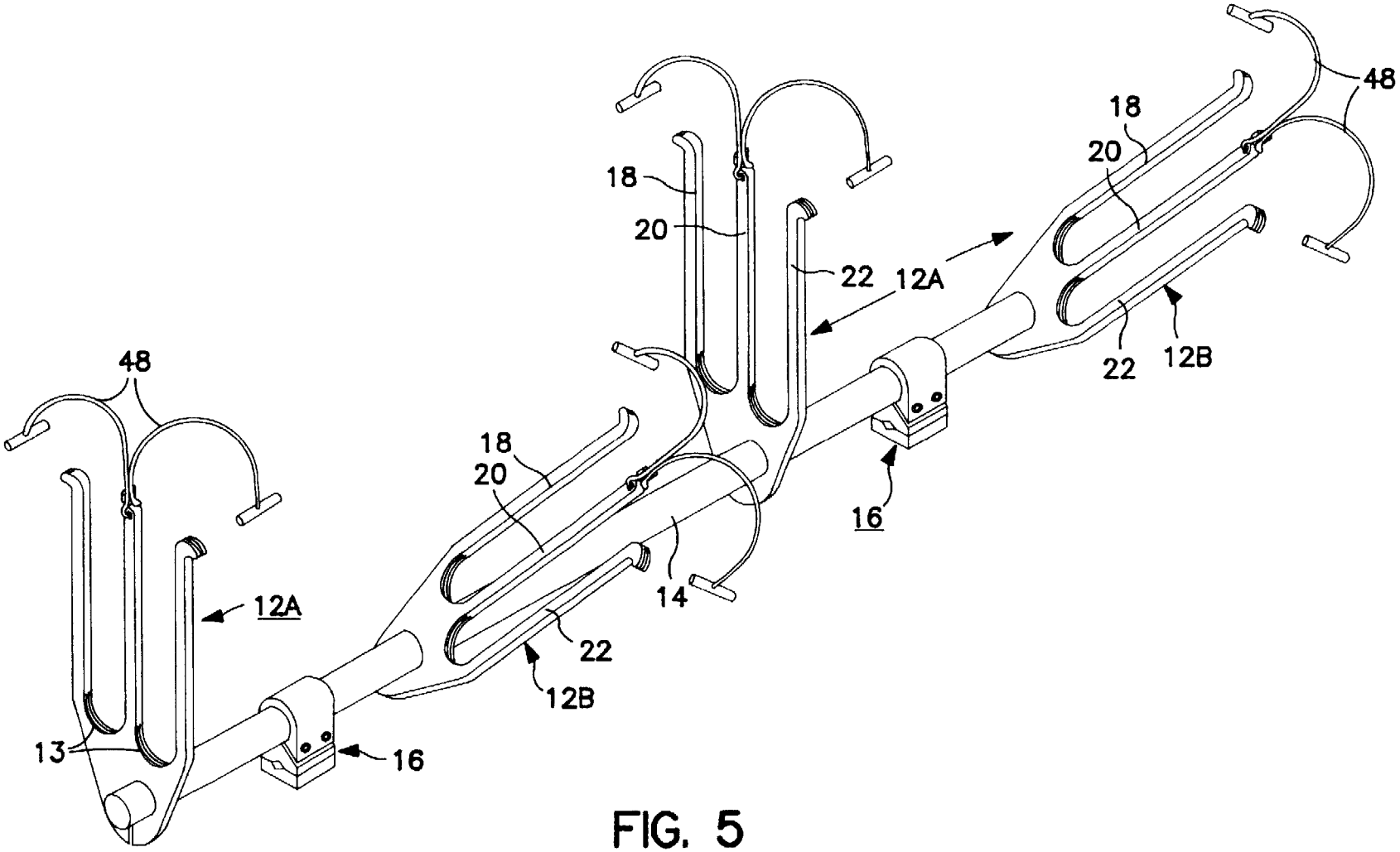
FIG. 5 shows an end view of two pairs of forks on the rack.

FIG. 5 shows a rack with two sets of forks, 12A and 12B. Forks 12A are oriented obliquely to forks 12B so that, as shown in the end view of FIG. 5, skis 63A may be retained by forks 12A and skis 63B may be retained by forks 12B.

Figure 6:
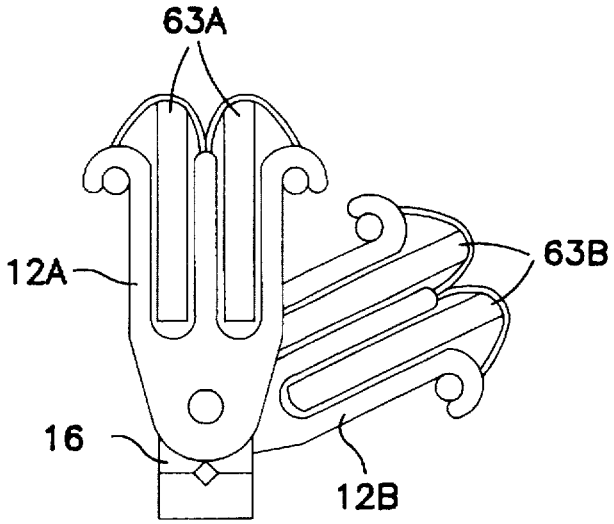
FIG. 6 shows the rack of FIG. 4 supporting two pairs of skis.
Figure 7:
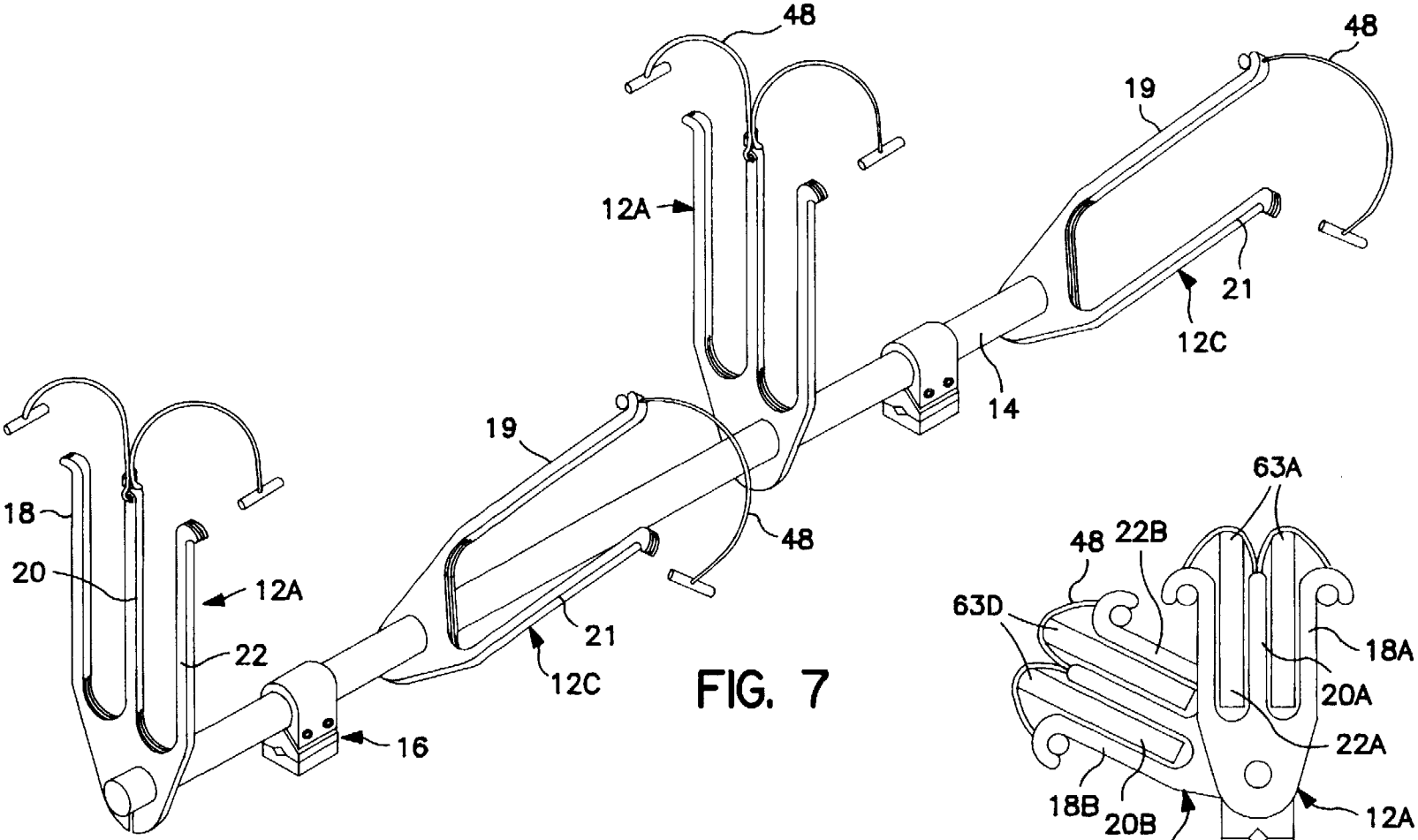
FIG. 7 shows a rack for storing one wakeboard and one pair of skis.

FIG. 7 shows a rack with two sets of forks, 12A and 12C. Forks 12C comprise only two prongs 19 and 21 and may be longer than the forks of 12A in order to more effectively retain a wakeboard. Forks 12A are oriented obliquely to forks 12C so that, as shown in the end view of FIG. 6, skis may be retained by forks 12A and a wakeboard may be retained by forks 12C.

Figure 8:
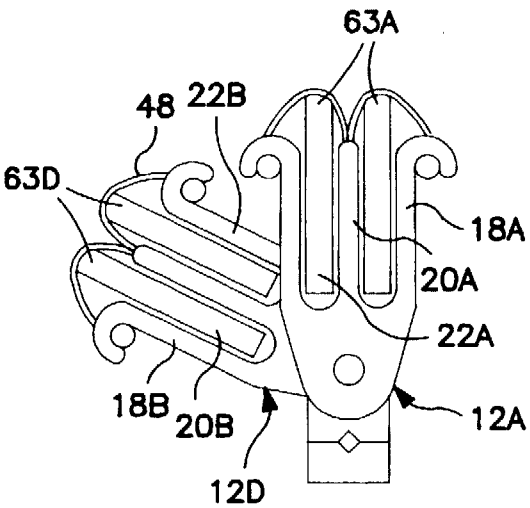
FIG. 8 shows a rack for a pair of skis and a pair of wake boards.

FIG. 8 is an end view of a rack with two sets of forks, 12A and 12D. Fork 12A has prongs 18A, 20A, 22A dimensioned to carry a pair of skis 63A. Fork 12D has prongs 18A, 20A, 22B dimensioned to carry a pair of wake boards.

Figure 9A:
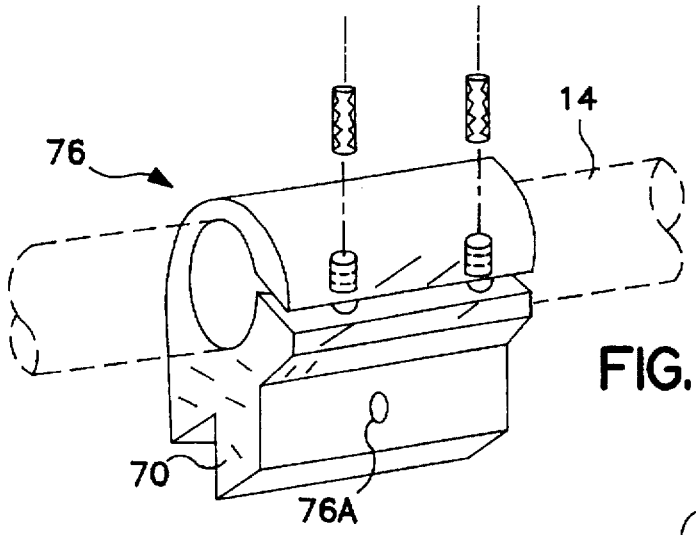
FIGS. 9A, 9B and 9C show various construction of the mounting bracket.
Figure 9B:
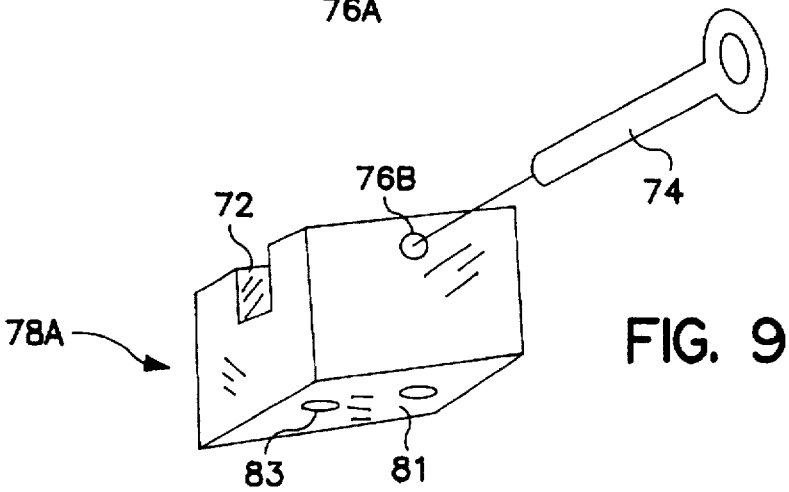

FIGS. 9A and 9B show another construction of the compound supporting base 40 for the rod including a block member 76 that is slidably mounted on rod 14 as discussed above and which engages mating member 78A which has a flat surface 81 to be attached to the flat surface of garage or truck wall, etc. by bolts or screws 83. The block member 76 has a rectangular tongue 70 that fits into groove 72 in the mating member 78A. The tongue 70 is aligned with the groove 72 so that a retractable pin 74 may be positioned through holes 76A and 76B in both the tongue 70 and groove 72 respectively.

The mating member is constructed according to the base for which it is intended. In FIG. 9A and 9B, the mating member 78A is constructed for attachment to a flat surface 81 with bolt holes 83.

Figure 9C:
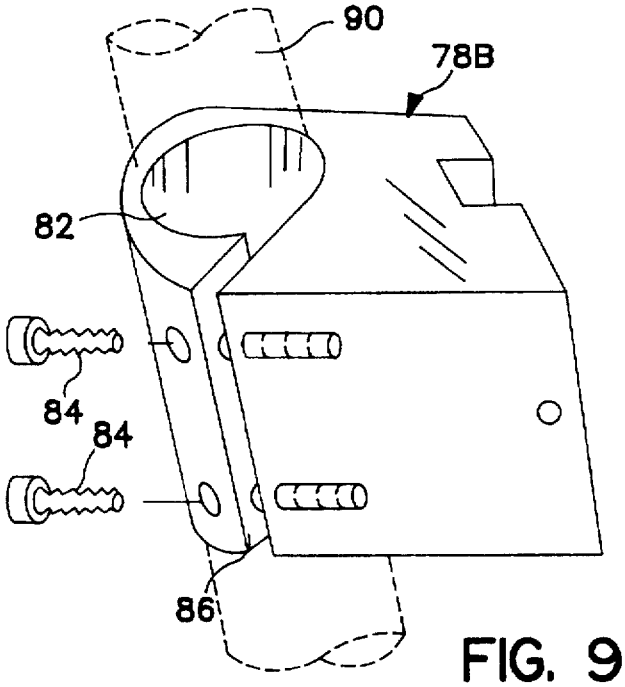
Figure 10:
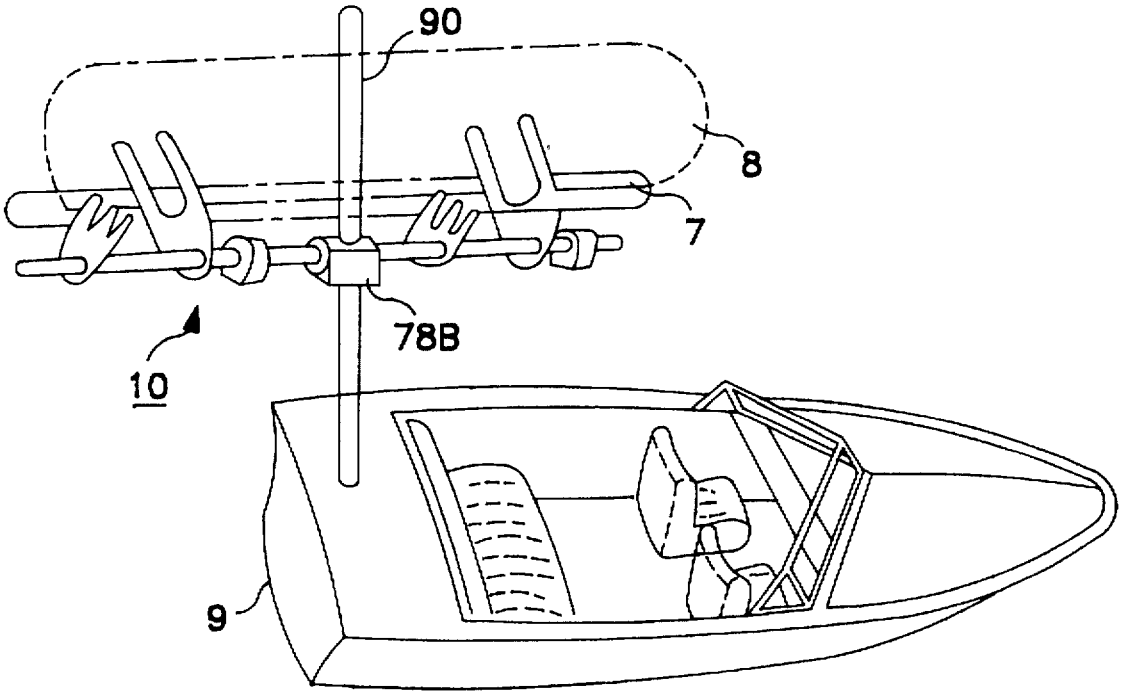
FIG. 10 shows the rack mounted on the mast of a boat.

In FIG. 9C, the mating member 78B is constructed for attachment to the pylon 90 (or mast) of a boat as shown in FIG. 10. The pylon 90 is slidably positioned in aperture 82 so that the mating member 78B can be squeezed onto pylon 90 by tightening bolts 84 which collapses slot 86.

In accordance with one object of the invention, the user can permanently bolt mating member 78A to a flat surface such as a truck sidewall or garage wall and, as shown in FIG. 10, permanently mount mating member 78B on the pylon 90 of a small boat so that the rack 10 can be transferred and stored in either location as required.

Figure 11:
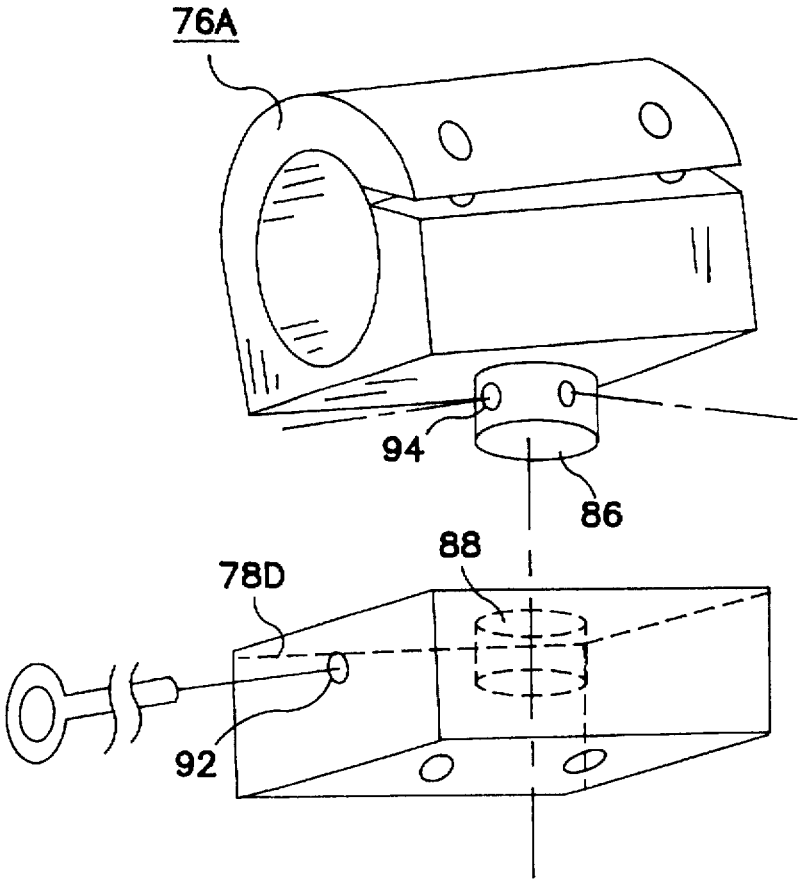
FIG. 11 shows one mounting bracket used for mounting the rack on the mast of a boat.

FIG. 11 shows a construction of the compound supporting base which may be mounted on a pylon 90. A tongue 86 is a cylinder on the block member 76A of the base support that mates with a cylindrical hole 88 in mating member 78D. The mating member 78D has an aperture 92 which can be aligned with any one of apertures 94 in mating member 76A providing that the orientation of the first part can be selected and fixed in selected orientation.

Figure 12:
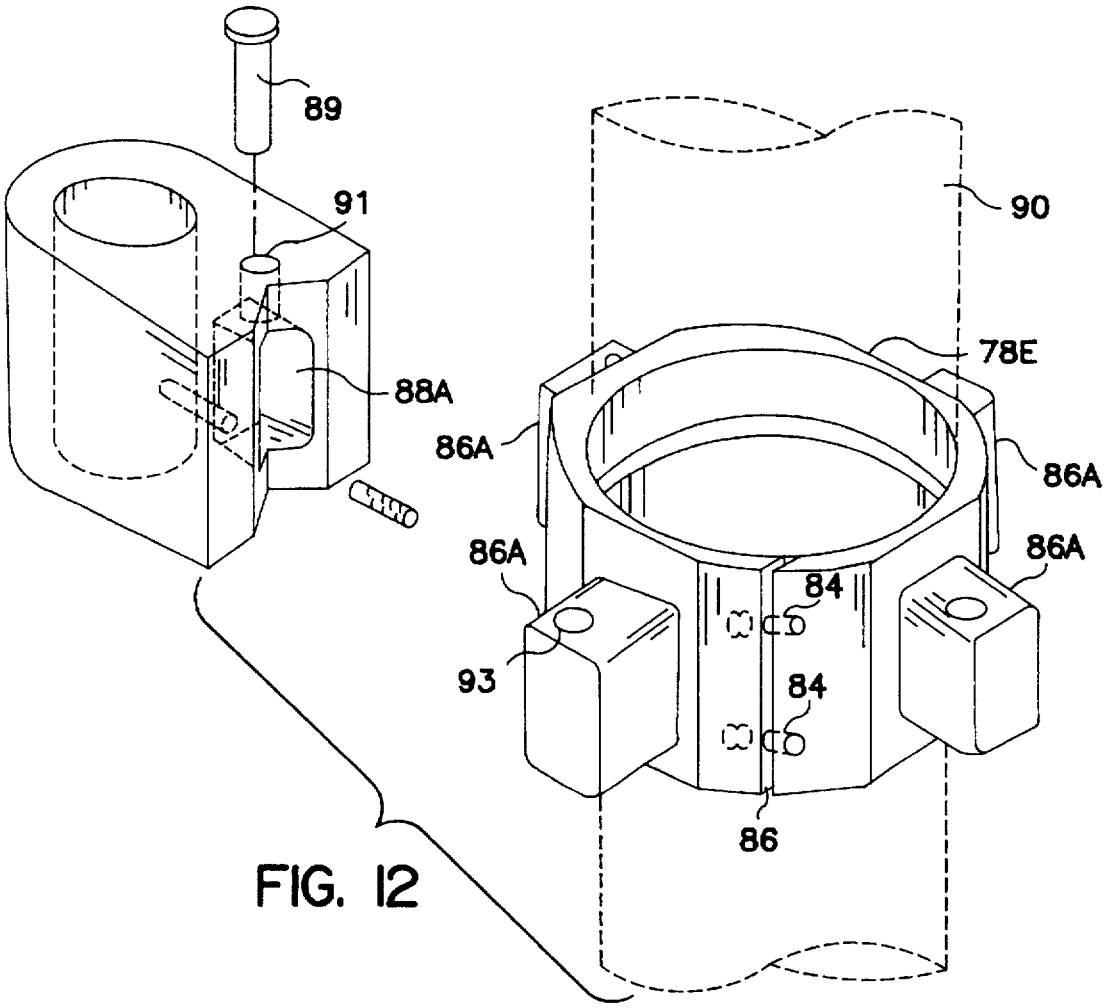
FIG. 12 shows another mounting bracket used for mounting the rack on the mast of a boat.

FIG. 12 shows another construction of a supporting base that may be mounted on pylon 90. The mating member 78E is a sleeve that slides onto the pylon 90. The sleeve 78E can be squeezed onto the pylon 90 by virtue of the slot 86 and bolts 84. The sleeve 78E has four tongues 86A arranged in quadrature around the sleeve 78E. Any one of the tongues 86A can be selected to mate with an aperture 88A in block member 76A so that the location for mounting the skis on the pylon can be selected by selecting any one of the tongues 86A. The selected tongue 86A may be secured in the aperture 88A by a pin 89 inserted into hole 91 in the block member 76A and hole 93 in selected tongue 86A.

Other variations and modifications suggested by studying the specification and drawings may be made in the ski rack of this invention which are within the scope of the invention. For example, in FIGS. 9 and 10, the tongue and groove can be interchanged. I therefore wish to define my invention by the appended claims.

I claim:

1. A rack for stowing water skis and wake boards which comprises:

at least one pair of forks, each fork having a plurality of prongs parallel to one another and a base plate forming a plurality of spaces;

said plurality of prongs of each fork extending from and coplanar with said respective base plate providing a plurality of spaces, each space being between neighboring prongs;

a support bar slidably positioned through a base opening in each base plate;

each base plate having a base slot extending from said respective opening to an edge of said base plate and a first bolt means operably arranged with said base slot for clamping said base plate onto said bar when said fork has been positioned axially on said bar and orientationally on said bar permitting said prongs of one of said pair of forks to be aligned with said prongs of another one of said pair of forks and permitting a ski and wakeboard to be placed in aligned spaces of each said pair of forks;

a bracket means for mounting said bar on a base surface;

a plurality of straps, one strap for each neighboring pair of prongs, an end of each one of said plurality of straps secured to an extending end of one of said prongs and means for detachably engaging an end of said each one of said plurality of straps with an extending end of a neighboring prong permitting one of said ski and wakeboard to be retained in said respective space between said neighboring prongs.

2. The rack of claim 1 wherein said bracket means comprises:

at least one block member having a block opening dimensioned to permit said block member to be slidably positioned on said support bar;

each one of said at least one block member having a block slot extending from said respective block opening to an edge of said block;

a second bolt means operably arranged with said block slot for clamping said block member onto said bar when said block member has been positioned axially on said bar and orientationally on said bar;

means for securing a surface of said block member to said support surface.

3. The rack of claim 2 wherein said means for securing comprises said at least one block member having a plurality of bolt holes for receiving bolts arranged to secure a surface of said block member to a support surface.

4. The rack of claim 2 wherein said means for securing comprises:

a block member;

a mating member, said block member having a mounting surface with one of a tongue means and groove means dimensioned for mating with a support surface of said mating member having respectively a groove means and a tongue means;

a locking pin;

at least one aperture in said block member;

at least one aperture in said mating member alignable with said at least one aperture in said block member providing that, when said one of said tongue means and said groove means of said block member is matingly engaged with one of said groove means and tongue means of said mating member respectively, and at least one of said apertures in one of said tongue means and said groove means of said block member is aligned with one of said at least one of said apertures in said one of said groove means and tongue means of said mating member respectively, then when said locking pin is positioned in said aligned apertures, said block member is secured to said mating member;

means for attaching said mating member to any one of:

(i) a wall;

(ii) a mast.

5. The rack of claim 4 wherein said means for attaching comprises:

said mating member being a sleeve and a tongue plate;

said sleeve having a substantially cylindrical surface and dimensioned for sliding onto said mast;

said sleeve having means for clamping said sleeve onto said mast;

at least one tongue extending from said cylindrical surface for engaging an aperture in said block member;

said tongue plate having at a extending from one surface of said tongue plate;

means for securing another surface of said tongue plate against said wall said block member having said aperture dimensioned to engage one of said at least said one tongue means whereby a user is enabled to detachably attach said rack to a selected one of said wall and said mast.

6. The rack of claim 2 which comprises:

at least one block plate, one block plate for each one of said at least one block member;

each said block plate having a plurality of bolt holes arranged for bolting a surface of said block plate against said surface of said block plate;

said surface of said each block plate having a groove and said surface of said surface of said at least one block member having a groove, both said grooves arranged together to form a mounting opening when said block plate is bolted to said block member;

said mounting opening adapted for clamping said block plate and member onto a railing with said railing extending through said mounting opening.

7. The rack of claim 1 wherein said plurality of prongs of at least one of said at least one pair of forks being at least two prongs having a length operably selected for storing a wake board.

8. The rack of claim 1 comprising:

said plurality of prongs of at least one of said at least one pair of forks being a first prong, second prong and third prong;

each prong of said first prong, second prong and third prong having a length operably selected for stowing a pair of skis with one ski of said pair of skis nested between said first and second prong and another ski of said pair of skis nested between said second prong and said third prong.

9. The rack of claim 1 comprising:

said plurality of prongs of at least one of said at least one pair of forks being a first prong, second prong and third prong;

each prong of said first prong, second prong and third prong having a length operably selected for stowing a pair of wakeboards with one wakeboard of said pair of wakeboards nested between said first and second prong and another wakeboard of said pair of wakeboards nested between said second prong and said third prong.

* * * * *